US006257585B1

(12) United States Patent
Mendes, Jr.

(10) Patent No.: US 6,257,585 B1
(45) Date of Patent: Jul. 10, 2001

(54) ARCADE RACING GAME

(75) Inventor: John F. Mendes, Jr., Ormond Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 0 days.

(21) Appl. No.: 09/506,678

(22) Filed: Feb. 17, 2000

Related U.S. Application Data

(63) Continuation-in-part of application No. 09/426,039, filed on Oct. 25, 1999.
(60) Provisional application No. 60/106,225, filed on Oct. 30, 1998.

(51) Int. Cl.[7] ..... A63F 9/14
(52) U.S. Cl. ..... 273/442; 273/441; 463/59; 463/62; 463/63
(58) Field of Search ..... 273/441, 442, 273/445, 454, 459, 460; 463/58, 62, 63

(56) References Cited

U.S. PATENT DOCUMENTS 2,148,828 * 2/1939 Myers ..... 273/442 X
3,568,332 * 3/1971 Koci et al. ..... 273/442 X
3,657,457 * 4/1972 Poynter ..... 273/442 X
4,059,266 * 11/1977 Nakamura ..... 273/442
4,335,878 6/1982 Nishimiya .
5,066,014 11/1991 Dobson .
5,407,212 4/1995 Dobson .
5,439,230 8/1995 Mendes, Jr. et al. .
5,566,950 10/1996 Senna .
5,573,243 11/1996 Bartosik .
5,667,217 9/1997 Kelly et al. .
5,669,607 9/1997 Silver et al. .
5,678,823 10/1997 Chaffee et al. .
5,954,338 9/1999 Hampton .

* cited by examiner

*Primary Examiner*—Raleigh W. Chiu
(74) *Attorney, Agent, or Firm*—Standley & Gilcrest LLP

(57) ABSTRACT

An arcade-style racing game is described. The game preferably includes a surface an actuator, a game piece, and a steering mechanism. A racing track may be depicted on the surface. An actuator is preferably adapted to rotate the surface about a central axis on command. The game piece is preferably positioned substantially adjacent to the surface. The steering mechanism is preferably connected to the game piece and it may be adapted to rotate or turn the game piece a predetermined range. With use of the steering mechanism, a game player may position the game piece substantially within the boundaries of the racing track as the surface rotates about the central axis.

20 Claims, 11 Drawing Sheets

ARCADE RACING GAME

This application is a continuation-in-part application claiming priority to application Ser. No. 09/426,039 filed Oct. 25, 1999, which claims the benefit of U.S. Provisional Application No. 60/106,225, filed Oct. 30, 1998.

BACKGROUND AND SUMMARY OF THE INVENTION

The present invention relates generally to an arcade-style racing game. A preferred embodiment of a game of the present invention preferably includes a base structure, a surface, an actuator, a game piece, and a steering mechanism. A racing track is preferably depicted on the surface. An actuator may be adapted to rotate the surface about a central axis on command. The game piece is preferably positioned substantially adjacent to the surface. The steering mechanism may be mechanically connected to the game piece, and it is preferably adapted to rotate the game piece a predetermined range. With use of the steering mechanism, a game player may position the game piece substantially within the boundaries of the racing track as the surface rotates about the central axis.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 2:
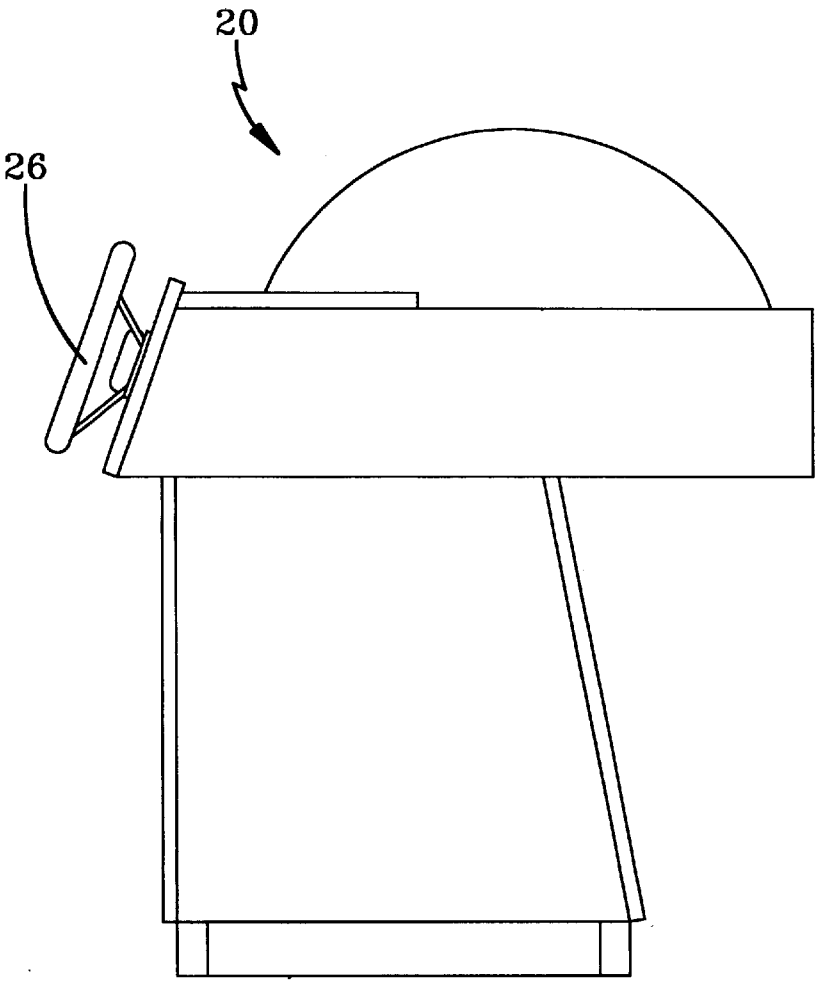
FIG. 2 is a side elevation view of the game shown in FIG. 1.
Figure 1:
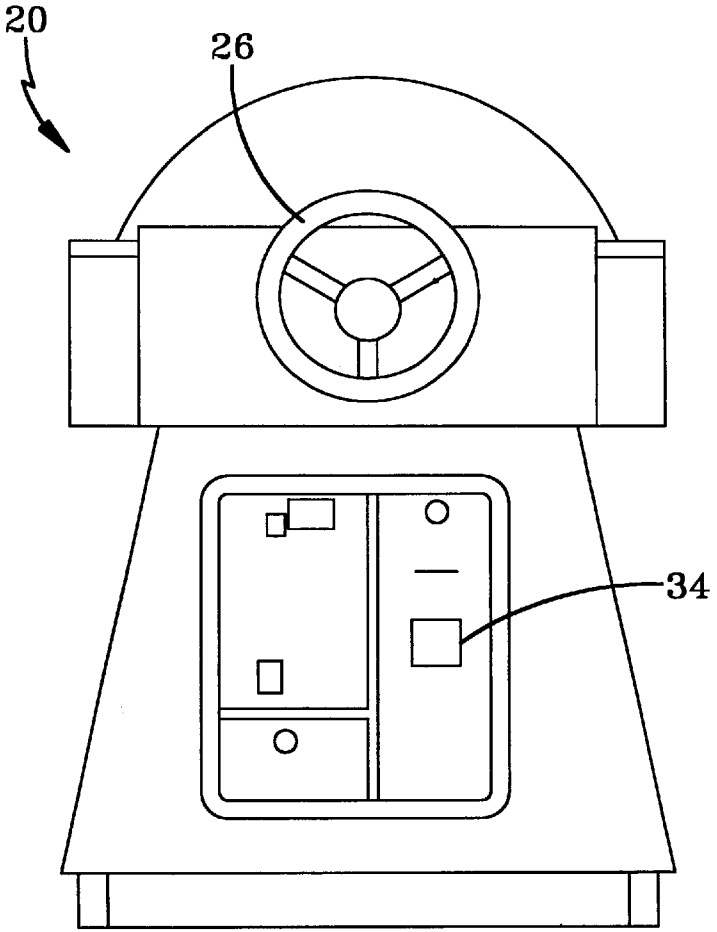
FIG. 1 is a front elevation view of a preferred embodiment of a game of the present invention.
Figure 3:
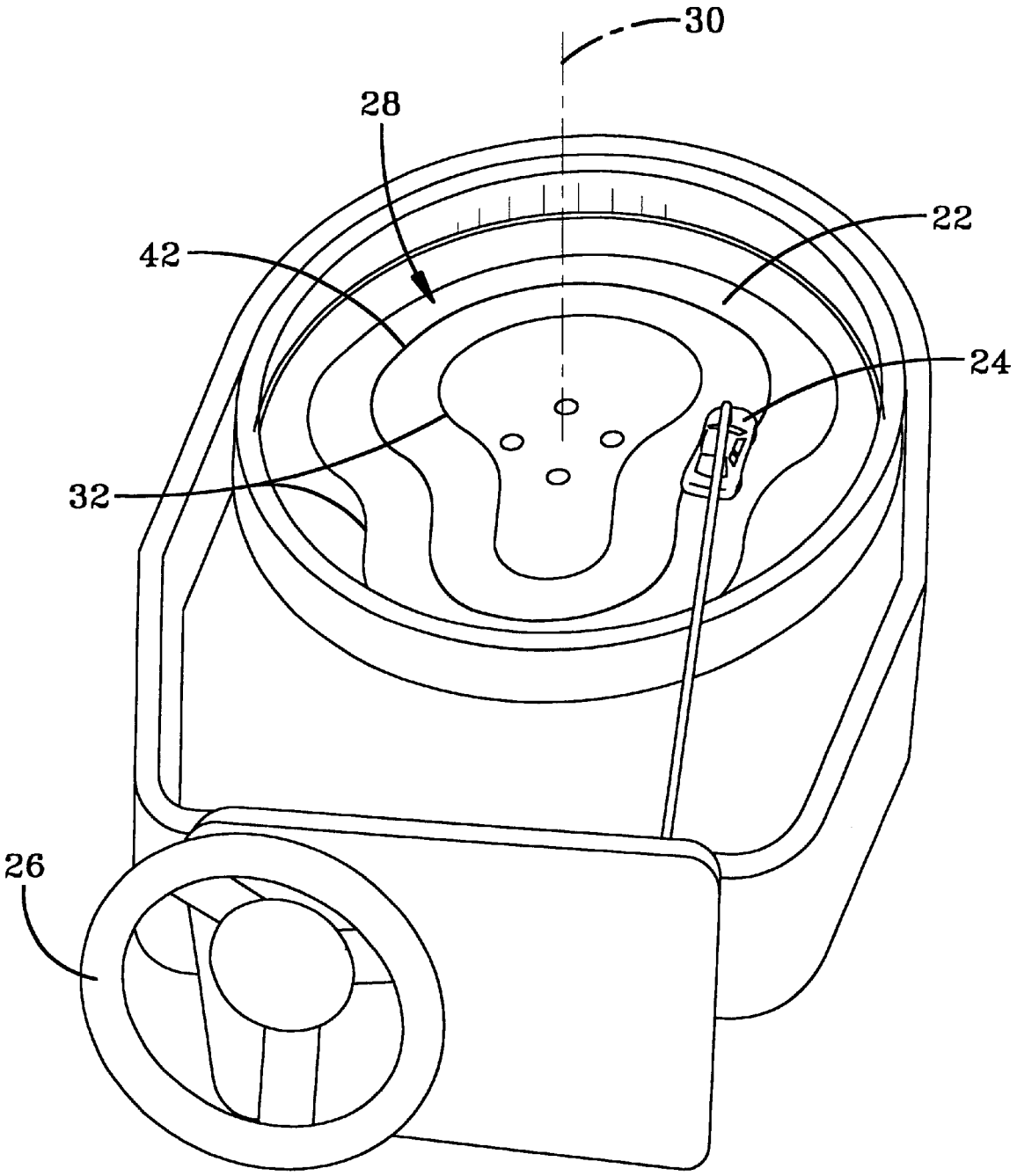
FIG. 3 is a pictorial view of the game shown in FIG. 1.
Figure 4:
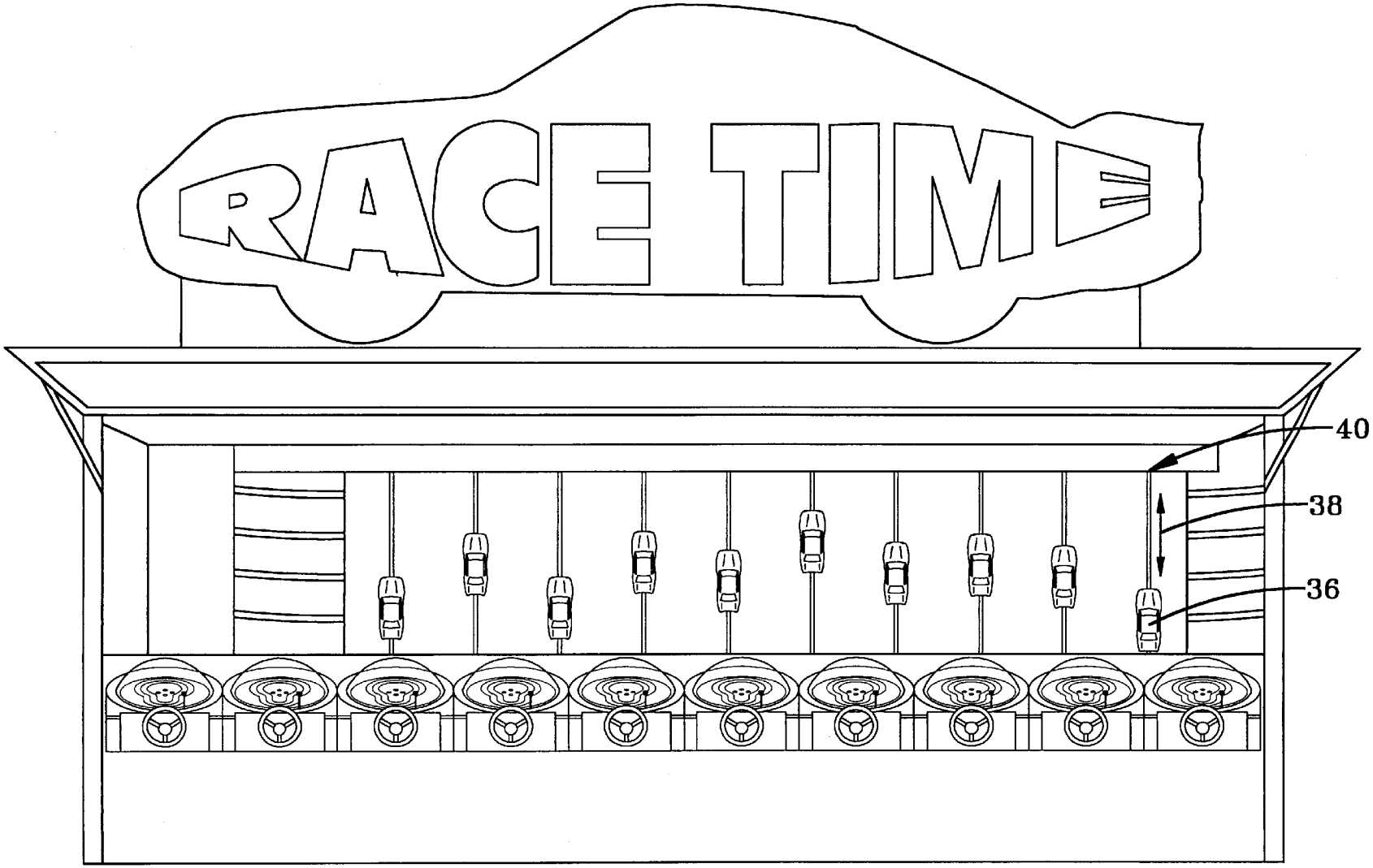
FIG. 4 is a side elevation view of a second preferred embodiment of a game of the present invention.
Figure 5:
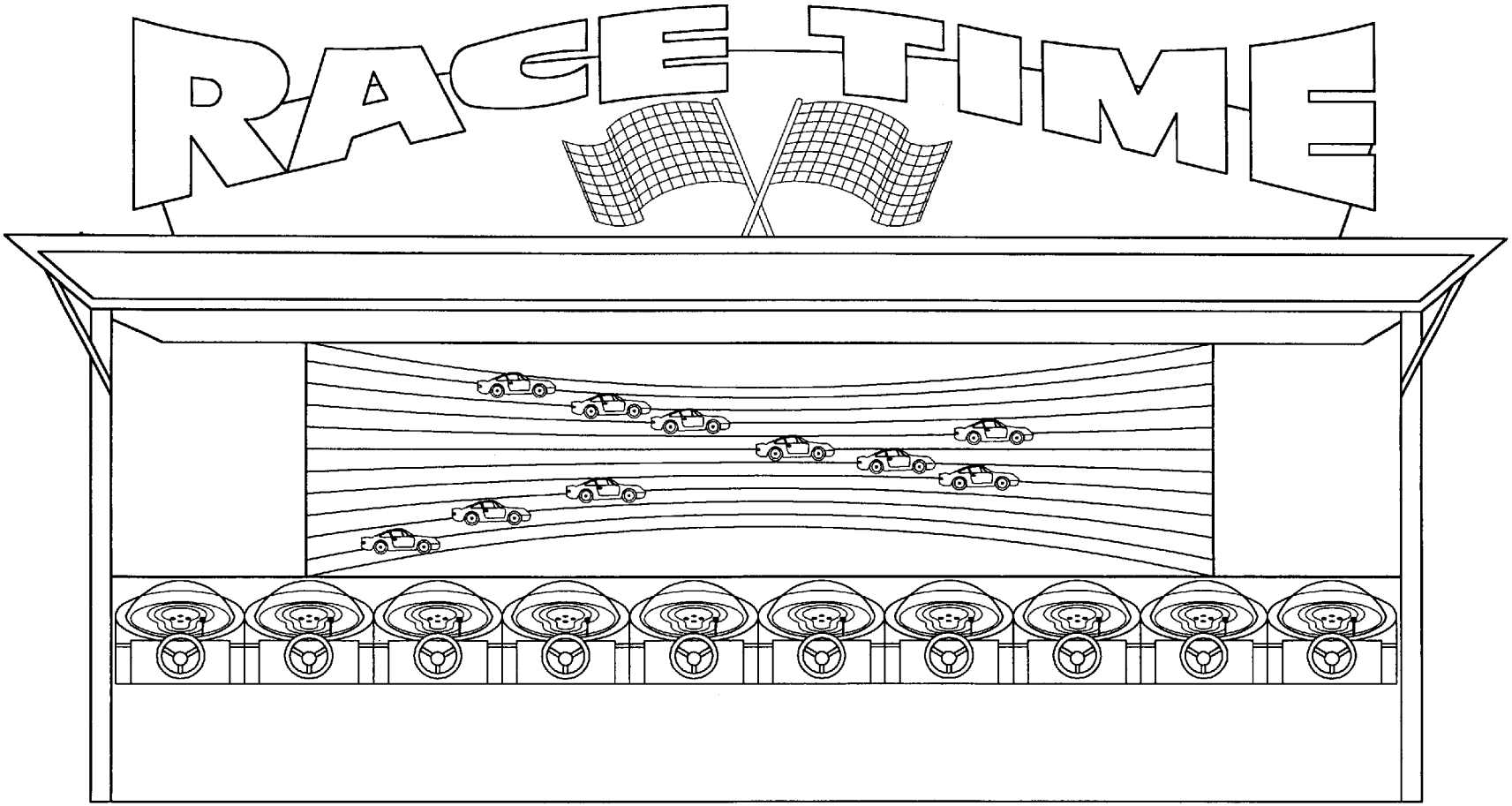
FIG. 5 is a side elevation view of a third preferred embodiment of a game of the present invention.
Figure 6:
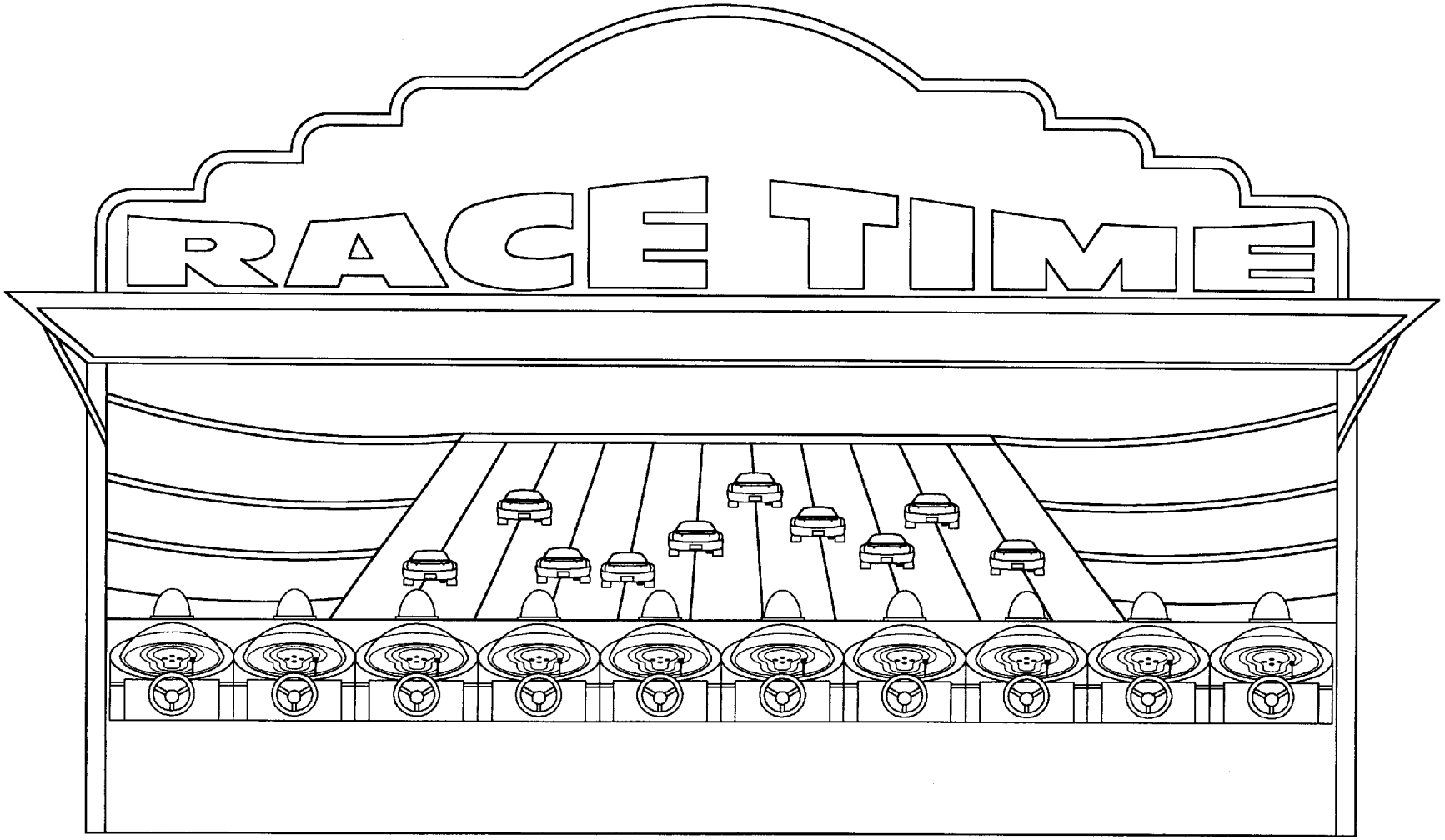
FIG. 6 is a side elevation view of a fourth preferred embodiment of a game of the present invention.
Figure 7:
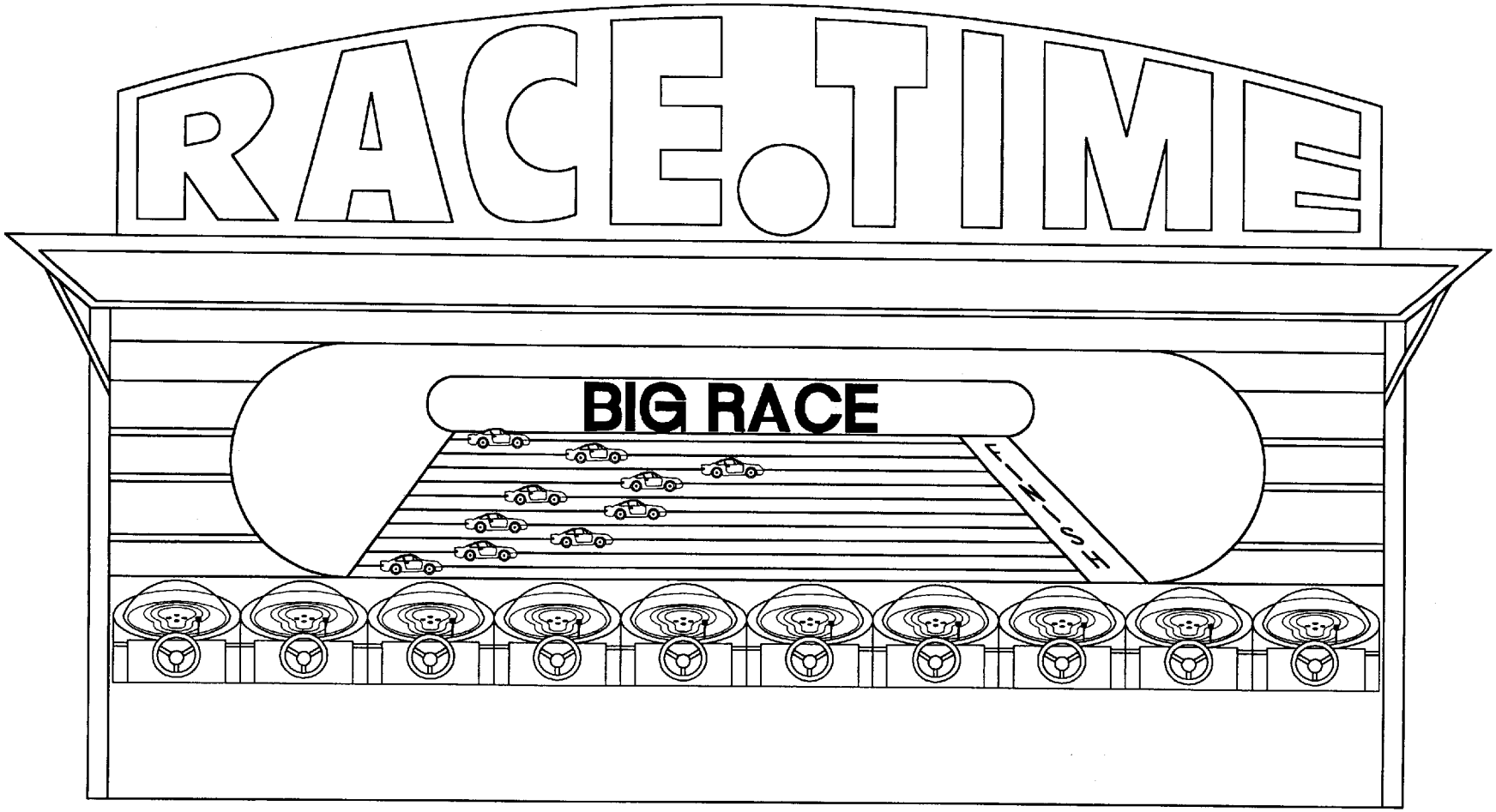
FIG. 7 is a side elevation view of a fifth preferred embodiment of a game of the present invention.
Figure 8:
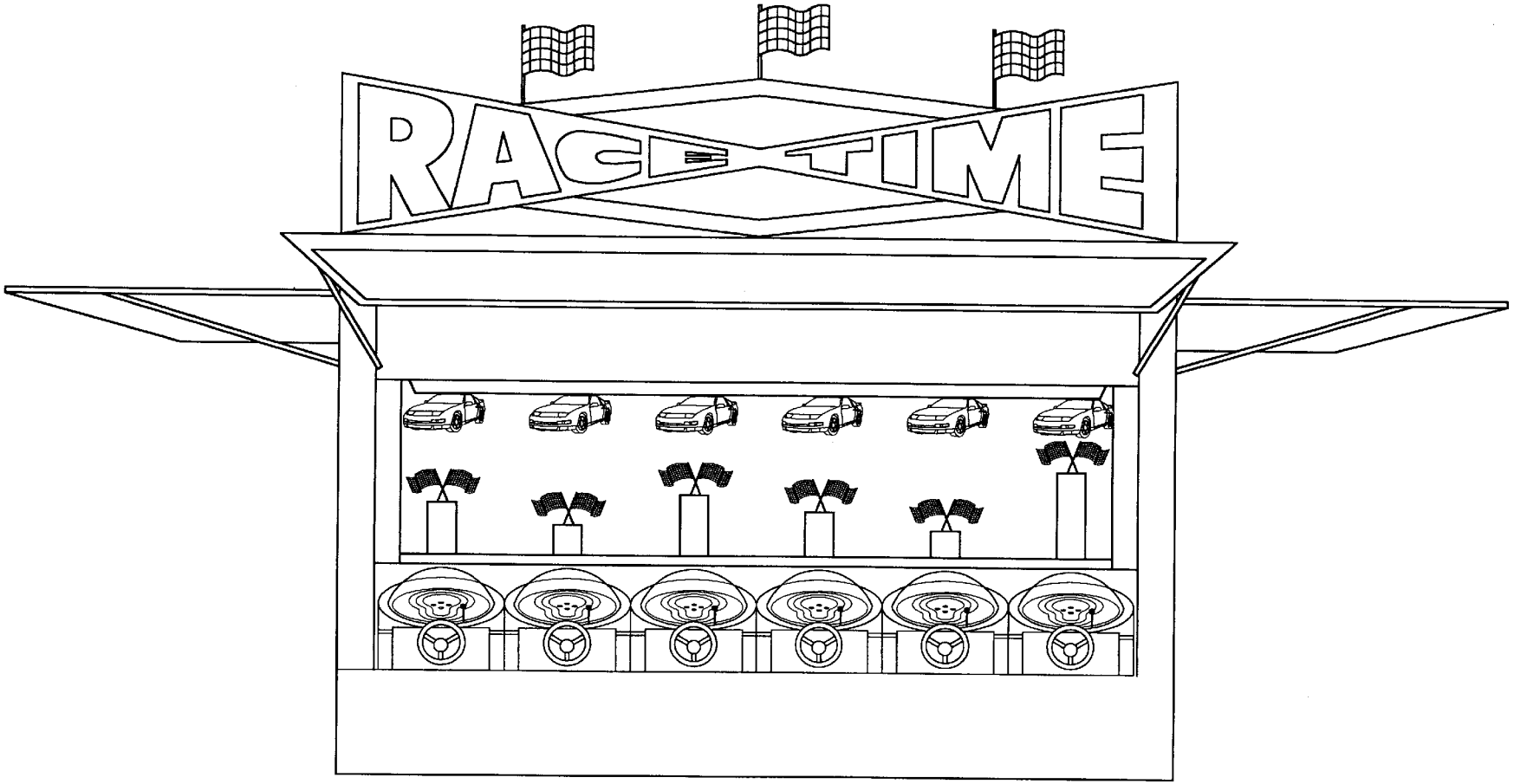
FIG. 8 is a side elevation view of a sixth preferred embodiment of a game of the present invention.
Figure 9:
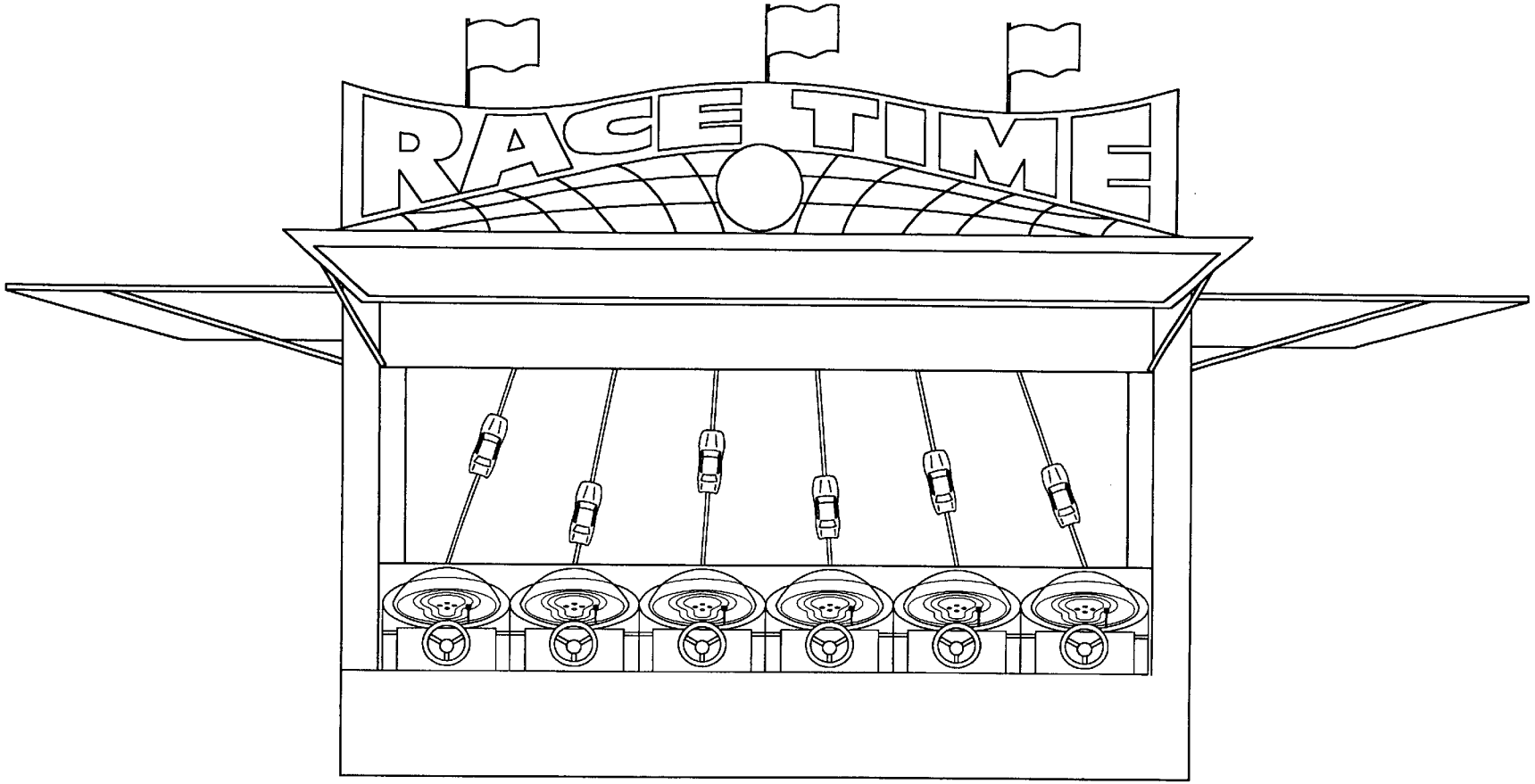
FIG. 9 is a side elevation view of a seventh preferred embodiment of a game of the present invention.
Figure 10:
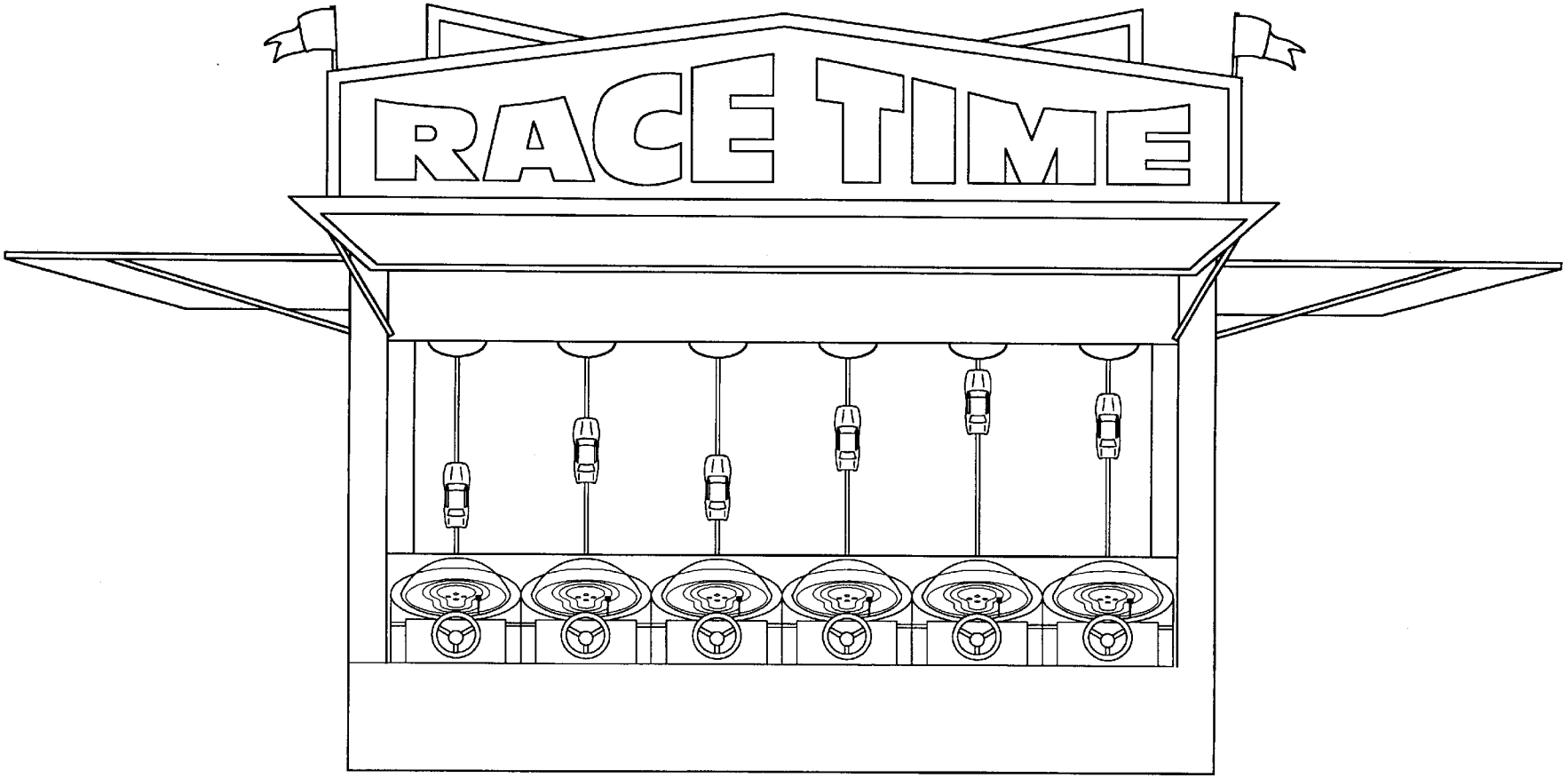
FIG. 10 is a side elevation view of a eighth preferred embodiment of a game of the present invention.

The present invention is directed to an arcade-style racing game. FIGS. 1 through 3 show one embodiment of a game 20 of the present invention. A preferred embodiment of a game of the present invention includes a surface 22, an actuator (e.g., 44), a game piece 24, and a steering mechanism 26. A racing track 28 may be depicted on the surface. The racing track may be depicted on the surface by any suitable means such as paint. It is preferred that the racing track be substantially flat. However, those skilled in the art should recognize that the racing track may have undulations. An actuator is adapted to rotate the surface about a central axis 30 on command. The actuator may comprise a stepper motor 44. A stepper motor 44 preferably facilitates measurement and/or control of how far the surface has rotated about the central axis 30. The game piece 24 is positioned adjacent to, or substantially adjacent to, the surface. The game piece 24 may be in practically any desired form such as a car or other vehicle. The steering mechanism 26 is preferably mechanically linked to the game piece 24, and it is adapted to rotate the game piece 24 a predetermined range (and/or move the game piece 24 to the left or right over the surface). The steering mechanism preferably includes a steering wheel. With use of the steering mechanism 26, a game player tries to position the game piece 24 substantially within the boundaries 32 and near the centerline 42 of the racing track as the surface rotates about the central axis 30. In one embodiment, the game may include sensors positioned along the boundaries 32 of the track to indicate and/or determine when a game piece 24 crosses over a boundary of the racing track.

In a preferred embodiment of the present invention, the game player may only be able to rotate (or turn) the game piece 24 a predetermined range about an axis under the game piece 24. In other preferred embodiments, the game player may be able to use the steering mechanism 26 to laterally move the axis of rotation of the game piece 24.

In one embodiment, the actuator may be adapted to rotate the surface at a constant speed. In another embodiment, the actuator may be adapted to rotate the surface at speeds that vary based on the performance of the game player. For example, the actuator may be adapted to increase the speed at which the surface is rotated when the game player positions the game piece 24 closer to the centerline 42 of the track or within the boundaries 32 of the racing track for a predetermined period of time, as the surface rotates about the central axis 30. Similarly, the actuator may be adapted to slow down the speed of rotation if the game player steers the game piece 24 away from the centerline 42 or the game piece 24 outside of the boundaries 32 of the racing track.

The game may last a fixed or variable time. For example, the actuator may only be adapted to rotate the surface for a predetermined time in some embodiments. In other embodiments, the actuator may be adapted to rotate the surface for a time period that varies based on the performance of the game player. For instance, the game may last longer if the game player is performing well.

The game may include an award dispenser 34. The award dispenser may be practically any conventional award dispenser known to those of ordinary skill in the art of arcade games. The award dispenser 34 may distribute items such as tickets, coupons, tokens, or other types of prizes or awards. In some embodiments, the award dispenser may only distribute a fixed award regardless of how well or poorly the game player performs. In other embodiments, the award dispenser may distribute awards that vary based on the performance of the game player.

The game may include an indicia 36 of advancement. The indicia 36 of advancement may be adapted to advance along a predetermined path 38 toward a predetermined destination 40. The game may end when the indicia 36 of advancement reaches the predetermined destination. In some embodiments, the indicia 36 of advancement may advance to the predetermined destination at a fixed speed while the player steers his or her game piece 24 along the surface (or track). In other embodiments, the indicia 36 of advancement may be adapted to advance toward the predetermined destination at a speed based on the performance of the game player. For example, the speed at which the indicia 36 of advancement advances toward the predetermined destination may increase when the game player maintains the game piece 24 closer to the centerline 42 of the track (speed decreases when the game piece 24 is farther from the centerline). In another embodiment, the speed at which the indicia 36 of advancement advances toward the predetermined destination may increase when the game player maintains the game piece 24 within the boundaries 32 of the racing track for a period of time as the surface rotates about the central axis, and the speed of the indicia 36 may decrease when the game player steers the game piece 24 outside the boundaries 32 of the track.

If a game player is racing against other game players, each game player may have his own indicia 36 of advancement. In such cases, the game may end when the first indicia 36 of advancement reaches its predetermined destination. With regard to a game player racing against at least one other game player, it should be recognized that the game may have more than one game piece 24 on the same racing track so that the game players may race on the same track. For example, the racing track may have a plurality of lanes. Each of the lanes may rotate independently of the other lanes. In such embodiments, the game preferably has a separate actuator for each lane. The game may be designed such that each player races in a separate lane. The game may include sensors positioned along the boundaries 32 of each lane to indicate and/or determine when a game 24 crosses over into another's lane. If a player's game piece 24 crosses over into another's lane, that player's lane or game piece may slow down relative to the other player's lane or game piece 24. Similarly, if a player maintains his game piece 24 within his lane, his lane or game piece 24 may speed up relative to the other player's lane or (game piece 24.

It should also be recognized that there may a separate racing track for each game player. FIGS. 4 through 10 show other embodiments of the present invention, which allow multiple game players to race against one another. For example, a preferred embodiment of a game of the present invention may include a plurality of surfaces, a plurality of actuators, a plurality of game pieces 24, a plurality of steering mechanisms 26, and a plurality of indicia 36 of advancement. Each of the surfaces may have a racing track depicted thereon. Each of the actuators is preferably adapted to rotate a respective one of the surfaces about a respective central axis on command. Each game piece 24 may be positioned substantially adjacent to, or over, a respective one of the surfaces. It is preferred that each steering mechanism is connected to a respective one of the game pieces 24, and each steering mechanism may be adapted to rotate a respective one of the game pieces 24 a predetermined range. Each indicia 36 of advancement may be adapted to advance along a respective predetermined path to a respective predetermined destination at a speed based on the performance of a respective game player. In such an embodiment, a plurality of game players may play the game simultaneously. In the preferred embodiment, each game player's game piece 24 will advance the indicia 36 of advancement based on how close each game piece 24 is to the centerline 42 of the game player's track. In another embodiment, each game player may position a respective one of the game pieces 24 within the boundaries 32 of a respective one of the racing tracks as a respective one of the surfaces rotates about a respective central axis. Furthermore, the game may end when a first one of the indicia 36 of advancement reaches its respective predetermined destination.

The game of the present invention may further include audio and/or visual indications of the progress of the game. For example, audio speakers may be electronically connected to the actuator and a preprogrammed sound card to produce a car crash sound if a player's game piece 24 leaves the track. In another embodiment, bright lights may flash when a first player's indicia 36 of advancement reaches its predetermined destination. Alone or in association with the bright lights, a loud siren may sound indicating that a player's indicia 36 of advancement is the first to reach its predetermined destination.

Figure 11:
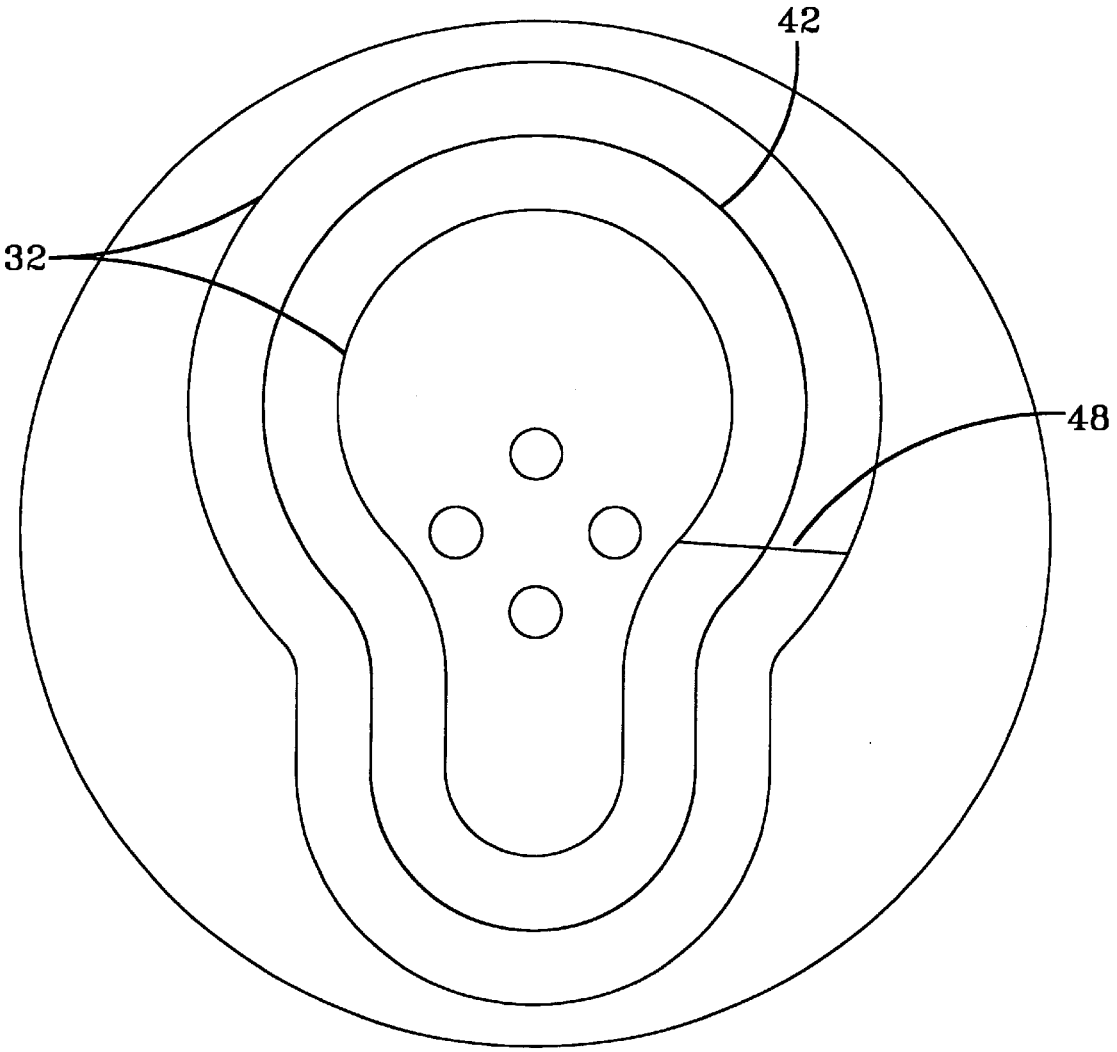
FIGS. 11 and 12 illustrate top plan views of the game surface.
Figure 12:
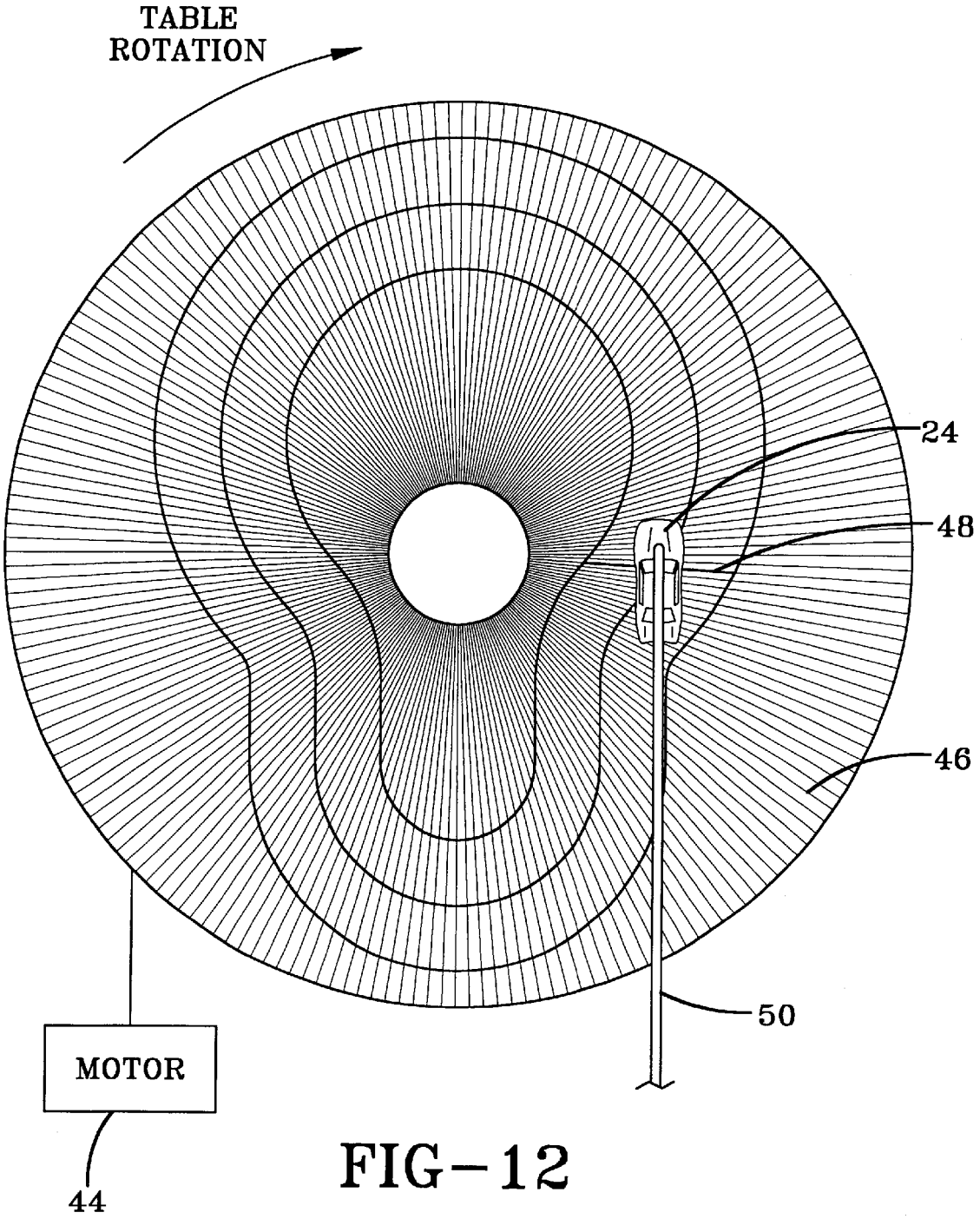

FIGS. 11 and 12 illustrate top plan views of one embodiment of the game of the present invention. The outline of the track of FIG. 11 illustrates the centerline 42 and boundaries 32. FIG. 12 illustrates the same track of FIG. 11, distinguished by a series of lines 46 superimposed over the table or surface. The lines are drawn from the center point, or origin, of the table to the outer edges. These lines, or radials 46, do not appear on the game itself—they are used for game programmers.

As the game surface rotates, the motor 44 and game program constantly track the degrees the surface has rotated. Therefore, the number of degrees the surface has rotated from a start position 48 is tracked and stored. In one embodiment, sensor technology is used to detect the degrees the surface has turned. In an alternate embodiment, a stepper motor 44 is calibrated so that the degrees the surface has turned can be determined from the stepper motor function. The game, via programming, knows by determining how many degrees the surface rotates which radial 46 is aligned with the fixed starting point 48 (in the preferred embodiment, a magnetic sensor attached to an edge of the table is used to return the table to the starting point at the end or start of every race). In FIG. 12 there are 200 radials 46 (the number of radials 46 may be increased for greater accuracy).

As an example, assume radial 1 is aligned with the fixed starting point 48. In one embodiment, if the surface (or table in some cases) rotates 90 degrees, radial 50 would be aligned with the fixed starting point 48. This first coordinate value (i.e., radial value) is one coordinate required to locate the relative position of the game piece 24 on the surface of the table.

A second coordinate value is determined by the game piece 24 along its axis as the game piece 24 is moved in the left and right direction (left and right from a reference point of facing the steering wheel of the game). As illustrated in the other drawings and in FIG. 12, the game piece 24 is connected to a connecting rod 50 at a single point. In the preferred embodiment, the rod 50 is attached at the other end to a gear and steering wheel 26. As the steering wheel 26 rotates, the rod 50 moves the game piece 24 between a left-most position and a right-most position on the game surface. In one embodiment, the rotation of the steering wheel 26 is measured by a sensing device, which is then stored as the second coordinate value (i.e., game piece position value). In another embodiment, game piece position values are determined by connecting the steering mechanism with a potentiometer. By measuring the resistance value or current through the potentiometer, the game can determine the location of the game piece over the game surface. In a preferred embodiment, the game is calibrated to allow the game piece 26 to move in a range of preset values divided into 256 positions from 0 to 255 (more positions can be added for greater accuracy).

The radial and game piece position values or coordinates are determined by the game system and processing equipment as the table surface rotates during game play. These collected values are preferably compared to stored values. In one embodiment of the game, the absolute position of the game piece from 0 to 255 is used. In another embodiment, the lateral distance traveled from a known start position may be used.

Accordingly, the table centerline and/or boundary position values (from 0 to 255 positions along the length of each radial, from the origin to the outer edge of the table, for example) can be programmed for each radial value. For example, the centerline position value may be 84 for radial 1 and 85 for radial 2, and so on (using the alternative distance measurement, the same positions might be radial 1, 12 inches from the origin and radial 2, 12.05 inches, and so on. As the surface rotates, the game piece position feedback may also be stated as a distance from an origin and compared to the desired centerline position value for each radial value. The absolute value of the difference is then used to determine the results as previously discussed.)

Accordingly, in operation, the data for determining performance includes the radial value, the centerline position (and/or boundary position) value for that radial, and the game piece position value. As the table surface turns, the radial value is continuously determined. Using the radial value, the desired centerline 42 or boundary positions are determined. The actual game piece position value is determined by movement of the steering wheel 26. The system continuously calculates the difference between a desired position value for each radial value (e.g., centerline position value) and the actual game piece position value. As discussed, if the difference between the values is small, the closer the game player is maintaining the game piece 24 to the desired value (e.g., centerline 42) which causes the indicia of advancement 36 (and/or table surface) to move faster. Similarly, the game may track when the game piece moves outside the boundary position values for each radial.

Furthermore, a tolerance of performance may be programmed for each application. For example, allowable bandwidths or zones can be programmed. A high-speed zone may be programmed as a half inch of either side of the centerline 42. A medium-speed zone may be a half inch to one inch from either side of the centerline 42. A slow-speed zone may be greater than one inch from either side of the centerline 42. In another embodiment, there are no set speed zones. As the game piece 24 moves further from the centerline 42, the performance result is proportionally adjusted.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A game comprising:

a plurality of surfaces, each of said surfaces having a racing track depicted thereon;

a plurality of actuators, each of said actuators adapted to rotate a respective one of said surfaces about a respective central axis on command;

a plurality of game pieces, each game piece positioned over a respective one of said surfaces;

a plurality of steering mechanisms, each steering mechanism connected to a respective one of said game pieces, each steering mechanism adapted to rotate a respective one of said game pieces a predetermined range; and a plurality of indicia of advancement, each indicia of advancement adapted to advance along a respective predetermined path toward a respective predetermined destination at speeds based on the performance of a respective game player.

2. The game of claim 1 wherein said game ends when one of said indicia of advancement reaches its respective predetermined destination.

3. A race game comprising:

a base structure;

a surface indicating a racing track, said surface supported by said base structure, said racing track having a centerline position;

an actuator adapted to rotate said surface about a central axis on command;

a game piece positioned over said surface; and a steering mechanism connected to said game, said steering mechanism adapted to enable lateral movement of said game piece over said surface;

a processor for determining player performance based on the actual position of said game piece over said surface; and an indicia of advancement in data communication with said processor for indicating progress of game play.

4. A race game according to claim 3, wherein said centerline position is indicated on said surface.

5. A race game according to claim 3, further comprising:

a means for determining the number of degrees said surface has rotated around said central axis and wherein said process is adapted to determine player performance based on the actual position of said game piece and the number of degrees the surface has rotated around said central axis.

6. A race game according to claim 5, wherein said processor is programmed to determine a radial value based on the number of degrees said surface has rotated around said central axis.

7. A race game according to claim 6, wherein said processor is programmed to determine a desired centerline position value based on determined radial value.

8. A game comprising:

a base structure;

a surface indication a racing track, said surface supported by said base structure;

an actuator adapted to rotate said surface about a central axis on command;

a game piece positioned over said surface;

a steering mechanism connected to said game piece, said steering mechanism adapted to enable movement of said game piece over a predetermined range; and a tracking system for determining the position of said game piece in relation to said surface.

9. The game of claim 8 wherein said actuator is adapted to rotate said surface at a constant speed.

10. The game of claim 8 wherein said actuator is adapted to rotate said surface at speeds that vary based on the performance of said game player.

11. The game of claim 10 wherein said actuator is adapted to increase the speed at which said surface is rotated when said game player maintains a position of said game piece within the boundaries of said racing track as said surface rotates about said central axis.

12. The game of claim 8 wherein said actuator is adapted to increase the speed at which said surface is rotated when said game player maintains a position of said game piece close to a centerline of said racing track as said surface rotates about said central axis.

13. The game of claim 8 wherein said actuator is adapted to rotate said surface for a time period that varies based on the performance of said game player.

14. The game of claim 8 further comprising an award dispenser connected to said base structure.

15. The game of claim 14 wherein said award dispenser distributes a fixed award.

16. The game of claim 14 wherein said award dispenser distributes awards that vary based on the performance of said game player.

17. The game of claim 8 wherein said steering mechanism includes a steering wheel.

18. The game of claim 8 further comprising an indicia of advancement adapted to advance along a predetermined path as said game is played.

19. The game of claim 8 further comprising an indicia of advancement adapted to advance along a predetermined path to a predetermined destination at speeds based on the performance of said game player.

20. The game of claim 19 wherein the speed at which said indicia of advancement advances to said predetermined destination increases when said game player positions said game piece within the boundaries of said racing track as said surface rotates about said central axis.

* * * * *

UNITED STATES PATENT AND TRADEMARK OFFICE

CERTIFICATE OF CORRECTION

PATENT NO. : 6,257,585 B1
DATED : July 10, 2001
INVENTOR(S) : John F. Mendes, Jr.

It is certified that error appears in the above-identified patent and that said Letters Patent is hereby corrected as shown below:

Column 3,
Line 33, please delete the symbol "(";

Column 6,
Line 49, please delete the word "indication" and replace it with -- indicating --;

Signed and Sealed this

Ninth Day of August, 2005

JON W. DUDAS
*Director of the United States Patent and Trademark Office*